US012233505B2

(12) United States Patent
Wiswell et al.

(10) Patent No.: US 12,233,505 B2
(45) Date of Patent: Feb. 25, 2025

(54) POLISHING SYSTEM WITH CAPACITIVE SHEAR SENSOR

(71) Applicant: Applied Materials, Inc., Santa Clara, CA (US)

(72) Inventors: Nicholas A. Wiswell, Sunnyvale, CA (US); Chih Chung Chou, San Jose, CA (US); Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 18/315,467

(22) Filed: May 10, 2023

(65) Prior Publication Data

US 2023/0278164 A1 Sep. 7, 2023

Related U.S. Application Data

(62) Division of application No. 16/522,287, filed on Jul. 25, 2019, now Pat. No. 11,660,722.

(Continued)

(51) Int. Cl.

| | |
|---|---|
| ***B24B 49/12*** | (2006.01) |
| ***B24B 37/013*** | (2012.01) |
| ***B24B 37/04*** | (2012.01) |

(52) U.S. Cl.

CPC ..... *B24B 49/12* (2013.01); *B24B 37/013* (2013.01); *B24B 37/042* (2013.01)

(58) Field of Classification Search

CPC ..... B24B 7/228; B24B 37/013; B24B 37/046; B24B 37/07; B24B 37/10; B24B 37/105; B24B 37/27; B24B 37/30; B24B 37/205; B24B 37/26; B24B 37/005; B24B 37/20; B24B 49/00; B24B 49/006; B24B 49/02; B24B 49/04; B24B 49/045; B24B 49/10;

(Continued)

(56) References Cited

U.S. PATENT DOCUMENTS

| | | | |
|---|---|---|---|
| 5,036,015 | A | 7/1991 | Sandhu et al. |
| 5,069,002 | A | 12/1991 | Sandhu et al. |

(Continued)

FOREIGN PATENT DOCUMENTS

| | | |
|---|---|---|
| CN | 1211487 | 3/1999 |
| CN | 1425190 | 6/2003 |

(Continued)

OTHER PUBLICATIONS

International Search Report and Written Opinion in International Appln. No. PCT/US2019/043466, dated Nov. 8, 2019, 12 pages.

(Continued)

*Primary Examiner* — Robert F Neibaur

(74) *Attorney, Agent, or Firm* — Fish & Richardson P.C.

(57) ABSTRACT

A polishing pad includes a sensor assembly surrounded by a lower portion of the polishing pad, and an upper portion including a pad portion disposed on the assembly and at least a portion of a polishing layer disposed on the lower portion. The sensor assembly includes a lower body having a first pair of electrodes formed thereon, a polymer body having a second pair of electrodes formed thereon and aligned with the first pair of electrodes, and a pair of gaps between the first pair of electrodes and the second pair of electrodes.

12 Claims, 4 Drawing Sheets

Related U.S. Application Data

(60) Provisional application No. 62/726,122, filed on Aug. 31, 2018.

(58) Field of Classification Search
CPC ..... B24B 49/16; B24B 49/12; B24B 49/105; H01L 21/30625; H01L 21/304; H01L 22/26; H01L 22/12
USPC ..... 451/5, 6, 8, 41, 285, 287, 288, 298
See application file for complete search history.

(56) References Cited

U.S. PATENT DOCUMENTS

| | | | |
|---|---|---|---|
| 5,486,129 | A | 1/1996 | Sandhu et al. |
| 5,597,341 | A | 1/1997 | Kodera et al. |
| 5,623,096 | A | 4/1997 | Bandyopadhyay |
| 5,639,388 | A | 6/1997 | Kimura et al. |
| 5,647,952 | A | 7/1997 | Chen |
| 5,700,180 | A | 12/1997 | Sandhu et al. |
| 5,738,562 | A | 4/1998 | Doan et al. |
| 5,743,784 | A | 4/1998 | Birang et al. |
| 5,830,041 | A | 11/1998 | Takahashi et al. |
| 5,846,882 | A | 12/1998 | Birang |
| 5,851,135 | A | 12/1998 | Sandhu et al. |
| 5,860,847 | A | 1/1999 | Sakurai et al. |
| 5,914,275 | A | 6/1999 | Kodera et al. |
| 5,948,205 | A | 9/1999 | Kodera et al. |
| 6,046,111 | A | 4/2000 | Robinson |
| 6,120,347 | A | 9/2000 | Sandhu et al. |
| 6,123,609 | A | 9/2000 | Satou |
| 6,191,037 | B1 | 2/2001 | Robinson et al. |
| 6,206,754 | B1 | 3/2001 | Moore |
| 6,257,953 | B1 | 7/2001 | Gitis et al. |
| 6,280,292 | B1 | 8/2001 | Sato et al. |
| 6,283,828 | B1 | 9/2001 | Numoto |
| 6,283,829 | B1 | 9/2001 | Molnar |
| 6,306,008 | B1 | 10/2001 | Moore |
| 6,319,106 | B2 | 11/2001 | Numoto |
| 6,340,434 | B1 | 1/2002 | Mizuno et al. |
| 6,364,746 | B2 | 4/2002 | Moore |
| 6,428,389 | B2 | 8/2002 | Sato et al. |
| 6,464,561 | B2 | 10/2002 | Sandhu et al. |
| 6,492,273 | B1 | 12/2002 | Hofmann et al. |
| 6,494,765 | B2 | 12/2002 | Gitis et al. |
| 6,520,834 | B1 | 2/2003 | Marshall |
| 6,572,444 | B1 | 6/2003 | Ball et al. |
| 6,590,737 | B2 | 7/2003 | Imamura |
| 6,623,334 | B1 | 9/2003 | Birang et al. |
| 6,634,924 | B1 | 10/2003 | Ono et al. |
| 6,699,791 | B2 | 3/2004 | Hofmann et al. |
| 6,711,829 | B2 | 3/2004 | Sano et al. |
| 6,773,332 | B2 | 8/2004 | Moore |
| 6,840,840 | B2 | 1/2005 | Moore |
| 6,869,498 | B1 | 3/2005 | Tsai et al. |
| 6,887,129 | B2 | 5/2005 | Birang et al. |
| 6,916,225 | B2 | 7/2005 | Sugiyama et al. |
| 6,969,297 | B2 | 11/2005 | Moore |
| 7,052,366 | B2 | 5/2006 | Wolf |
| 7,513,818 | B2 | 4/2009 | Miller et al. |
| 7,727,049 | B2 | 6/2010 | Benvegnu et al. |
| 8,342,906 | B2 | 1/2013 | Miller et al. |
| 8,758,086 | B2 | 6/2014 | Miller et al. |
| 9,061,394 | B2 | 6/2015 | Chang et al. |
| 10,391,610 | B2 | 8/2019 | Iravani et al. |
| 2001/0008476 | A1* | 7/2001 | Imamura ..... G11B 21/16 360/246.2 |
| 2001/0010999 | A1 | 8/2001 | Numoto |
| 2001/0012750 | A1 | 8/2001 | Moore |
| 2002/0016131 | A1 | 2/2002 | Sandhu et al. |
| 2002/0037681 | A1 | 3/2002 | Gitis et al. |
| 2002/0090889 | A1 | 7/2002 | Crevasse et al. |
| 2002/0127951 | A1 | 9/2002 | Ishikawa et al. |
| 2005/0136800 | A1* | 6/2005 | Miller ..... B24B 37/013 451/41 |
| 2006/0003673 | A1 | 1/2006 | Moore |
| 2006/0141907 | A1 | 6/2006 | Rudolph et al. |
| 2007/0087662 | A1 | 4/2007 | Benvegnu et al. |
| 2008/0004743 | A1 | 1/2008 | Goers et al. |
| 2008/0087069 | A1* | 4/2008 | Renken ..... G01L 9/0073 73/723 |
| 2013/0122782 | A1 | 5/2013 | Chang et al. |
| 2014/0138355 | A1 | 5/2014 | Yavelberg |
| 2017/0133252 | A1 | 5/2017 | Fung et al. |
| 2018/0056476 | A1 | 3/2018 | Zhang et al. |
| 2020/0070306 | A1 | 3/2020 | Wiswell et al. |

FOREIGN PATENT DOCUMENTS

| | | |
|---|---|---|
| CN | 1781666 | 6/2006 |
| CN | 1871504 | 11/2006 |
| CN | 101894739 | 11/2010 |
| CN | 101791781 | 12/2012 |
| CN | 101479075 | 1/2013 |
| CN | 103959446 | 5/2013 |
| CN | 205380555 | 7/2016 |
| EP | 0771611 | 5/1997 |
| JP | S63-191550 | 8/1988 |
| JP | H07-237937 | 9/1995 |
| JP | H10-256209 | 9/1998 |
| JP | 2000-065720 | 3/2000 |
| JP | 2001-001260 | 1/2001 |
| JP | 2001-129756 | 5/2001 |
| JP | 2002-529686 | 9/2002 |
| JP | 2003-508904 | 3/2003 |
| JP | 2010-506407 | 2/2010 |
| JP | 2010-064220 | 3/2010 |
| JP | 2013-170896 | 9/2013 |
| JP | 2018-535107 | 11/2018 |
| KR | 10-1387917 | 4/2014 |
| KR | 10-1399837 | 5/2014 |
| TW | 200819243 | 5/2008 |
| TW | 201819107 | 6/2018 |
| TW | 201826368 | 7/2018 |
| WO | WO 2005/043132 | 5/2005 |
| WO | WO 2008/042903 | 4/2008 |

OTHER PUBLICATIONS

Machine Translation of KR-101399837-B1 (Year: 2014).
Office Action in Chinese Appln. No. 201980062694.2, dated Oct. 31, 2022, 17 pages (with English translation).
Office Action in Japanese Appln. No. 2021-509999, dated May 23, 2023, 8 pages (with English translation).
Office Action in Taiwanese Appln. No. 108130251, dated Jul. 31, 2023, 21 pages (with English summary and search report).
Cheng et al., "A Polymer-Based Capacitive Sensing Array for Normal and Shear Force Measurement," Sensors, Nov. 15, 2010, 10:10211-10225.

* cited by examiner

POLISHING SYSTEM WITH CAPACITIVE SHEAR SENSOR

CROSS-REFERENCE TO RELATED APPLICATION

This application is a divisional application of U.S. patent application Ser. No. 16/522,287, filed Jul. 25, 20219, which claims priority to U.S. Provisional Patent Application No. 62/726,122, filed Aug. 31, 2018, the disclosures of which are incorporated by reference.

TECHNICAL FIELD

The present disclosure relates to in-situ monitoring of friction during polishing of a substrate.

BACKGROUND

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive layer may be deposited onto a patterned dielectric layer. After planarization, the portions of the metal layer in trenches in the dielectric layer can provide conductive lines, vias, contact pads, and the like. In addition, planarization may be needed to provide a suitably flat substrate surface for photolithography.

Chemical mechanical polishing (CMP) is one accepted method of planarization. This planarization method typically requires that the substrate be mounted on a carrier head. The exposed surface of the substrate is placed against a polishing surface, such as a rotating polishing pad. The carrier head provides a controllable load of the substrate against the polishing pad. A polishing slurry, typically including abrasive particles, is supplied to the polishing surface.

One problem in CMP is determining whether the polishing process is complete, i.e., whether a substrate layer has been planarized to a desired flatness or thickness, when a desired amount of material has been removed, or when an underlying layer has been exposed. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

In-situ monitoring of the substrate has been performed, e.g., with optical or eddy current sensors, in order to detect the polishing endpoint. However, techniques relying on detection of a change in conductivity or reflectivity between two substrate layers deposited upon a substrate can be ineffective when the two layers have similar conductivity and reflectivity.

SUMMARY

In general, in one aspect, a chemical mechanical polishing system includes a platen to support a polishing pad, a carrier head to hold a substrate and bring a lower surface of the substrate into contact with the polishing pad, and an in-situ friction monitoring system including a friction sensor. The friction sensor includes a pad portion having a substrate contacting portion with an upper surface to contact the lower surface of the substrate, and a pair of capacitive sensors positioned below and on opposing sides of the substrate contacting portion.

Implementations may include one or more of the following features.

The in-situ friction monitoring system may be configured to determine a sequence of differences over time between a first signal from a first of the pair of capacitive sensors and a second signal from a second of the pair of capacitive sensors. The controller may be configured to determine at least one of a polishing endpoint or a change to a pressure applied by the carrier head based on the sequence of differences.

The friction sensor may include a lower body having a first pair of electrodes formed thereon, a polymer body having a second pair of electrodes formed thereon and aligned with the first pair of electrodes, and a pair of gaps between the first pair of electrodes and the second pair of electrodes, each stack of a first electrode, gap and second electrode providing one of the pair of capacitive sensors. The polymer body may include a main body and a plurality of projections extending from the main body to contact the lower body, and recesses between the projections may define the gaps. The polymer body may be a molded silicone. The lower body may be a printed circuit board. The pad portion may be supported on the polymer body.

The pad portion may include a lower portion, the substrate contacting portion may project upwardly from the lower portion, and the lower portion may extend laterally beyond all sides of the substrate contacting portion.

The system may include the polishing pad. The pad portion may be integrally joined to a remainder of a polishing layer of the polishing pad. The pad portion may include a lower portion, the substrate contacting portion may project upwardly from the lower portion, and the lower portion may extends laterally beyond all sides of the substrate contacting portion to be joined to the polishing pad. The friction sensor may be secured to the polishing pad. A bottom surface of the friction sensor may be coplanar with or recessed relative to a bottom surface of the polishing pad. The upper surface of the pad portion may be coplanar with a polishing surface of the polishing pad. The substrate contacting portion and a polishing layer of the polishing pad may be a same material.

The friction sensor may include two pairs of capacitive sensors, each pair of capacitive sensors positioned below and on opposing sides of the substrate contacting portion. The in-situ friction monitoring system may be configured to determine a total frictional force as a square root of a sum of the squares of a plurality of differences, the plurality of differences including first difference between signals from a first pair of the two pairs of capacitive sensors and a second difference between signals from a second pair of the two pairs of capacitive sensors.

In another aspect, a polishing pad includes an assembly surrounded by a lower portion of the polishing pad, and an upper portion including a pad portion disposed on the assembly and at least a portion of a polishing layer disposed on the lower portion. The assembly includes a lower body having a first pair of electrodes formed thereon, a polymer body having a second pair of electrodes formed thereon and aligned with the first pair of electrodes, and a pair of gaps between the first pair of electrodes and the second pair of electrodes.

In another aspect, a method of monitoring a frictional coefficient of a substrate during a polishing operation includes positioning a surface of a substrate in contact with a polishing surface and simultaneously in contact with a top surface of a substrate contacting member, causing relative motion between the substrate and the polishing surface, the relative motion applying a frictional force to the substrate contacting member which increases pressure on a first capacitive sensor and decreases pressure on a second capacitive sensor, and generating a signal indicating a shear on the substrate contacting member based on a difference between signals from the first and second capacitive sensors.

In another aspect, a method of fabricating a polishing pad includes providing an assembly surrounding by a lower portion of a polishing pad, and fabricating an upper portion of the polishing pad by an additive manufacturing process that includes droplet ejection of pad precursor material onto the assembly and the lower portion. The assembly includes a lower body having a first pair of electrodes formed thereon, a polymer body having a second pair of electrodes formed thereon and aligned with the first pair of electrodes, and a pair of gaps between the first pair of electrodes and the second pair of electrodes.

Implementations may have some, all, or none of the following advantages. Planarization of a layer being polished, or exposure of any underlying layer, may be detected more accurately and/or when the layer being polished and the layer to be exposed have similar optical or conductive properties. The friction sensor can be small, and complex mechanical parts can be avoided. The friction sensor can be integrated with the polishing pad, enabling ease of manufacture.

The details of one or more embodiments are set forth in the accompanying drawings and the description below. Other aspects, features, and advantages will be apparent from the description and drawings, and from the claims.

DESCRIPTION OF DRAWINGS

FIG. 2 is a cross-section along line 2-2 in FIG. 3.

Like reference symbols in the various drawings indicate like elements.

DETAILED DESCRIPTION

Friction-based monitoring of chemical mechanical polishing has been proposed. For example, a sensor include a flexible plate, e.g., a leaf spring, on which a piece of polishing pad is mounted. The sensor can measure the strain on a flexible plate to generate a signal representative of the friction from the substrate. However, such sensor can be bulky. For example, the vertical length of the plate may present form factor problems given the space available in the platen. Moreover, installation of the sensor in the polishing pad can be cumbersome. However, a capacitive sensor can take up less space, can generate a signal representative from which a direction of friction can be determined, and/or can be integrated into a polishing pad for ease of installation. In addition, a capacitive sensor can provide increased precision and accuracy in friction measurements. Contacts for the sensor can be placed on the bottom of the polishing pad, such that electrical connection to other circuitry can be performed easily.

Figure 1A:
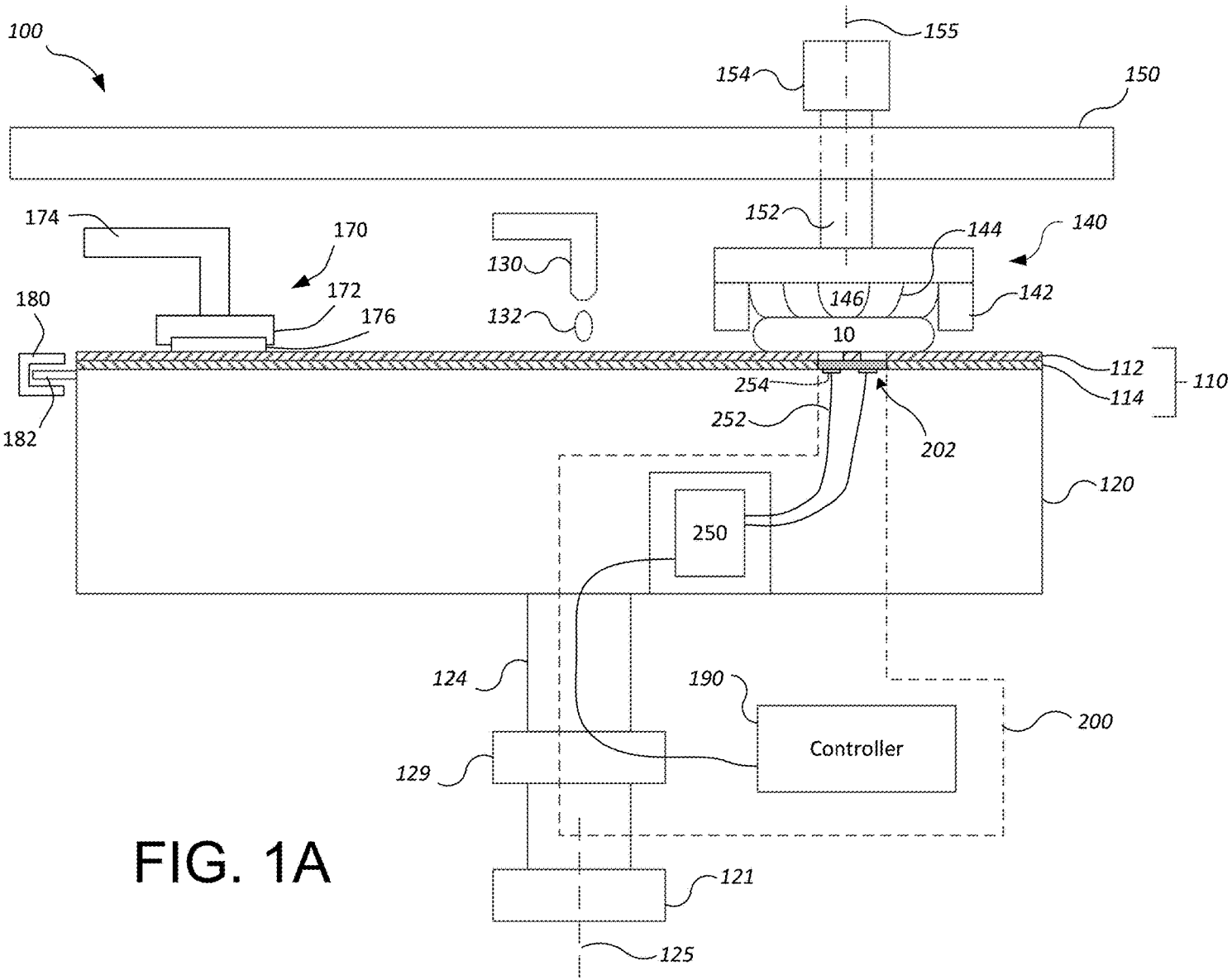
FIG. 1A is a schematic side view, partially cross-sectional, of a chemical mechanical polishing station that includes an eddy current monitoring system.
Figure 1B:
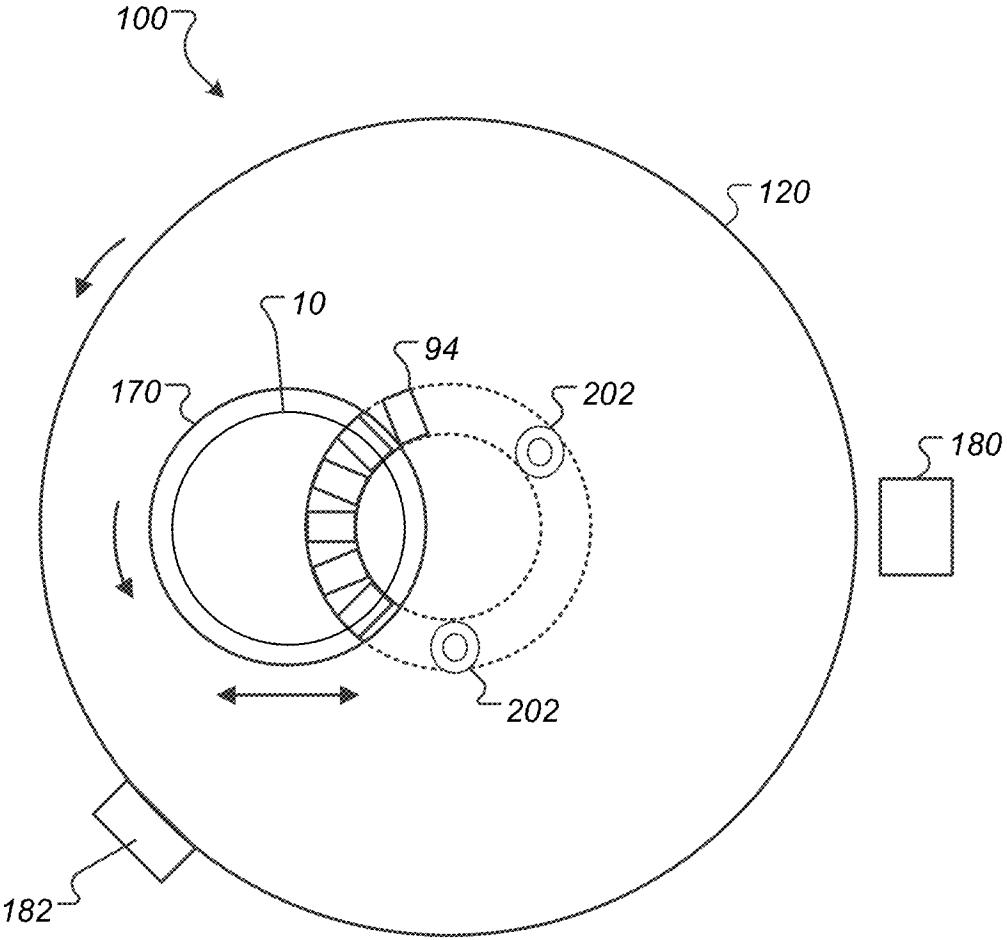
FIG. 1B is a schematic top view of a chemical mechanical polishing station.

FIGS. 1A and 1B illustrate an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120.

The polishing pad 110 can be a two-layer polishing pad with an outer polishing layer 112 and a softer backing layer 114. The polishing layer 112 can be formed to have a plurality of plateaus 116 separated by grooves 118 (see FIG. 2). The grooves 118 in the polishing surface of the polishing layer 112 can serve to carry a polishing liquid.

The polishing apparatus 100 can include a port 130 to dispense the polishing liquid 132, such as slurry, onto the polishing pad 110.

The polishing apparatus can also include a polishing pad conditioner 170 to abrade the polishing pad 110 to maintain the polishing pad 110 in a consistent abrasive state. In addition, conditioning improves consistency of friction between the substrate and the polishing pad. The polishing pad conditioner 170 can include a conditioner head 172 that permits the conditioner head 172 to sweep radially over the polishing pad 110 as the platen 120 rotates. The conditioner head 172 can hold a conditioner disk 176, e.g., a metal disk having abrasives, e.g., diamond grit, on the lower surface. The conditioning process tends to wear away the polishing pad 110 over time, until the polishing pad 110 needs to be replaced.

The polishing apparatus 100 includes at least one carrier head 140. The carrier head 140 is operable to hold a substrate 10 against the polishing pad 110. The carrier head 140 can have independent control of the polishing parameters, for example pressure, associated with each respective substrate.

In particular, the carrier head 140 can include a retaining ring 142 to retain the substrate 10 below a flexible membrane 144. The carrier head 140 also includes a plurality of independently controllable pressurizable chambers 146 defined by the membrane, and which can apply independently controllable pressures to associated zones on the flexible membrane 144 and thus on the substrate 10. Although only three chambers 146 are illustrated in FIG. 1 for ease of illustration, there could be one or two chambers, or four or more chambers, e.g., five chambers.

The carrier head 140 is suspended from a support structure 150, e.g., a carousel or a track, and is connected by a drive shaft 152 to a carrier head rotation motor 154 so that the carrier head can rotate about an axis 155. Optionally the carrier head 140 can oscillate laterally, e.g., on sliders on the carousel 150 or track; or by rotational oscillation of the carousel itself. In operation, the platen is rotated about its central axis 125, and the carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently.

The polishing apparatus 100 also includes an in-situ monitoring system 200. In particular, the in-situ monitoring system 200 generates a time-varying sequence of values that depend on the friction of the surface of layer on the substrate 10 that is being polished. The in-situ monitoring system 200 includes a sensor 202 which generates a signal that depends on the frictional coefficient of a localized, discrete area of the substrate 10. Due to relative motion between the substrate 10 and the sensor 202, measurements can be taken at different locations on the substrate 10.

The CMP apparatus 100 can also include a position sensor 180, such as an optical interrupter, to sense when the sensor 202 is beneath the substrate 10. For example, the optical interrupter 180 could be mounted at a fixed point opposite the carrier head 140. A flag 182 is attached to the periphery of the platen. The point of attachment and length of flag 182 is selected so that it interrupts the optical signal of sensor 180 while the sensor 202 sweeps beneath substrate 10. Alternatively or in addition, the CMP apparatus 100 can include an encoder to determine the angular position of platen.

If needed, sense circuitry 250 can be used to receive an analog signal, e.g., a voltage or current level, from the sensor 202, e.g., on wires 252. The sense circuitry 250 can be located in a recess in the platen 120, or could be located outside the platen 120 and be coupled to sensor 202 through a rotary electrical union 129. In some implementations, the drive and sense circuitry receives multiple analog signals from the sensor 202, and converts those analog signals into a serial digital signal.

A controller 190, such as a general purpose programmable digital computer, receives the signal from the sensing circuitry 250 or directly from the sensor 202. The controller 190 can include a processor, memory, and I/O devices, as well as an output device e.g., a monitor, and an input device, e.g., a keyboard. The signals can pass from the sensor 202 to the controller 190 through the rotary electrical union 129. Alternatively, the sense circuitry 250 could communicate with the controller 190 by a wireless signal.

The controller 190 can be configured to convert the signals from the sensor 202 into a series of values indicative of the coefficient of friction of the substrate 10. As such, some functionality of the controller 190 can be considered part of the in-situ monitoring system 200.

Since the sensor 202 sweeps beneath the substrate with each rotation of the platen, information on the friction is accumulated in-situ and on a continuous real-time basis (once per platen rotation). The controller 190 can be programmed to sample measurements when the substrate generally overlies the sensor 202 (as determined by the position sensor 180). As polishing progresses, the coefficient of friction of the surface of the substrate changes, and the sampled signals can vary with time. The time varying sampled signals may be referred to as traces. The measurements from the monitoring systems can be displayed on the output device during polishing to permit the operator of the device to visually monitor the progress of the polishing operation.

In operation, the CMP apparatus 100 can use the in-situ monitoring system 200 to determine when the bulk of the filler layer has been removed and/or to determine when the underlying stop layer has been substantially exposed. In particular, when an underlying layer is exposed, there should be a sudden change in the coefficient of friction. This change can be detected, e.g., by detecting changes in slope of the trace, or by detecting that the amplitude or slope of the trace passes a threshold value. Detection of exposure of the underlying layer can trigger the polishing endpoint and halt polishing.

The controller 190 may also be connected to the pressure mechanisms that control the pressure applied by carrier head 140, to carrier head rotation motor 174 to control the carrier head rotation rate, to the platen rotation motor 121 to control the platen rotation rate, or to slurry distribution system 130 to control the slurry composition supplied to the polishing pad. In addition, the computer 190 can be programmed to divide the measurements from the sensor 202 from each sweep beneath the substrate into a plurality of sampling zones 194, to calculate the radial position of each sampling zone, and to sort the amplitude measurements into radial ranges. After sorting the measurements into radial ranges, information on the film thickness can be fed in real-time into a closed-loop controller to periodically or continuously modify the polishing pressure profile applied by a carrier head in order to provide improved polishing uniformity.

Now referring to FIGS. 2 and 3, the sensor 202 can includes a pad portion 210 having a top surface 212 configured to contact the substrate, and at least one pair of capacitive sensors 220 positioned below and on opposite sides of the pad portion 210. The sensor 202 can include a lower body 240, which can be a printed circuit board, and a polymer body 230. Gaps between the lower body 240 and the polymer body 230 define the spaces between opposite electrodes of the capacitive sensors 220.

The pad portion 210 includes a substrate contacting portion 214, the upper surface of which provides the top surface 212 to contact the polishing pad. The substrate contacting portion 214 can have a lateral cross-section (see FIG. 3) which is square, circular, or some other suitable shape. The substrate contacting portion 214 can have a width W of about 0.2-0.5 mm, and a height H of about 0.2-1 mm. The height H of the upper portion 214 can be greater than the width W of the substrate contacting portion 214.

The pad portion 210 can optionally also include a lower portion 216 that extends laterally outward on all sides of the substrate contacting portion 214; the lower portion 216 that has a lateral dimension that is greater than the lateral dimension of the substrate contacting portion 214. The lower portion 216 can extend entirely across the capacitive sensors 220, and can extend entirely across the polymer portion 240. The lower portion 216, if present, can have a height less than the height of the upper portion, e.g., about 0.1-0.5 mm.

In some implementations, the lower portion 216 extends to and contacts the remainder of the polishing pad 110. The lower portion 216 can be secured to the polishing layer 112, e.g., with an adhesive. Alternatively, the lower portion 216 can be integrally joined to the remainder of the polishing pad 110, i.e., without an adhesive, seam or similar discontinuity.

In some implementations, there is a gap between the side edges of the lower portion 216 and the polishing pad 110.

In general, the substrate contacting portion 214 is formed of a material that does not adversely impact the polishing process, e.g., it should be chemically compatible with the polishing environment and sufficiently soft as to avoid scratching or damaging the substrate. The pad portion 210 can be the same material as the polishing layer 112 of the polishing pad 110, e.g., a polyurethane. Alternatively, the pad portion 210 can be a different material than the polishing layer 112, e.g., an acrylate.

The pad portion 210 can be supported on the polymer body 230. The bottom surface of the pad portion 210 can be secured to the top surface of the polymer body 230, e.g., by an adhesive or by fabricating the pad portion 210 directly on the polymer body 230.

A plurality of projections 232 extend from the bottom of a main body 234 of the polymer body 230 to contact the lower body 240, e.g., the printed circuit board. Recesses between the projections 232 define gaps 236 between the polymer body 230 and the lower body 240. The polymer body 230 can be secured to the lower body 240, e.g., by adhesive. The gaps 236 can partially underlie the substrate contacting portion 214. For example, the width of the projection 232 can be less than the width W of the substrate contacting portion 214. Alternatively, the gaps 236 can be laterally spaced so that they do not directly underlie the substrate contacting portion 214. For example, the width of the projection 232 can be greater than the width W of the substrate contacting portion 214.

The polymer body 230 can be silicone material, e.g., polydimethylsiloxane (PDMS). The polymer body 230 can be formed by a molding process, e.g., injection molding into the form having the projections 232 extending from a main body 234.

The interior horizontal surfaces of the recesses can be coated with a conductive material to form electrodes 238. The sidewall surfaces of the recesses (i.e., the sides of the projections) need not be coated.

As noted above, the lower body 240 can be a printed circuit board. Electrodes 242 are formed on a top surface of the lower body 240, and conductive contacts 244 can be formed on the bottom surface of the lower body 240. In addition, the lower body 240 can include conductive lead lines 246, e.g., extending through the thickness of the lower body, to electrically connect each electrode 242 with a corresponding conductive contact 244.

In some implementations, electrical contacts 254 can be formed on the top surface of the platen 120 (see FIG. 1A). These electrical contacts 254 are connected by the wires 252 to the sense circuitry 250 and/or controller 190. Thus, when the polishing pad 110 is installed on the platen 120, each conductive contact 244 makes an electrical connection to a corresponding electrical contact 254. This permits the electrical connection of the sensor 202 to other components, e.g., the sense circuitry 250 and/or controller 190, to be made quickly and easily. When the polymer body 230 is secured to the lower body 240, each electrode 238 on the polymer body 230 is aligned with a corresponding electrode 242 on the lower body 240 with a gap 236 between. A set of two electrodes 238, 242 with a gap 236 therebetween provides a capacitive pressure sensor 220. In brief, if the space between the electrodes 238, 242 changes, this will result in a change in capacitance and thus a change in a signal sensed by circuitry coupled to the sensor 220, e.g., through the conductive contact 244.

In a rest state, e.g., when not being compressed by pressure from a substrate, the gap 236 can have a height of 10 to 50 microns. The electrodes 238, 242 can have a lateral dimension of 0.5 to 1 mm. The electrodes 238, 242 and the gap 238 can be square, circular, or another suitable lateral cross-sectional shape.

A pair of capacitive pressure sensors 220*a*, 220*b* positioned on opposing sides of a midline of the substrate contacting portion 214 can provide a shear sensor. In particular, frictional drag on the substrate contacting portion 214 from the substrate will tend to apply a torque on the pad portion 210. This will cause a differential in pressure on the two sensors 220*a*, 220*b*. For example, if the substrate 10 is moving rightward across the polishing pad 110, friction on the pad portion 210 will tend to increase pressure on the right-hand capacitive pressure sensor 220*a*, and reduce pressure on the left-hand capacitive pressure sensor 220*b*. Conversely, if the substrate 10 is moving leftward across the polishing pad 110, friction on the pad portion 210 will tend to reduce pressure on the right-hand capacitive pressure sensor 220*a*, and increase pressure on the left-hand capacitive pressure sensor 220*b*.

To detect the amount of shear, and thus measure the friction between the substrate and the substrate contacting portion 214, a differential between the signals from the two sensors 220*a*, 220*b* can be calculated. For example, the signal from the right-hand capacitive pressure sensor 220*a* can be subtracted from the signal from the left-hand capacitive pressure sensor 220*b*.

Figure 3:
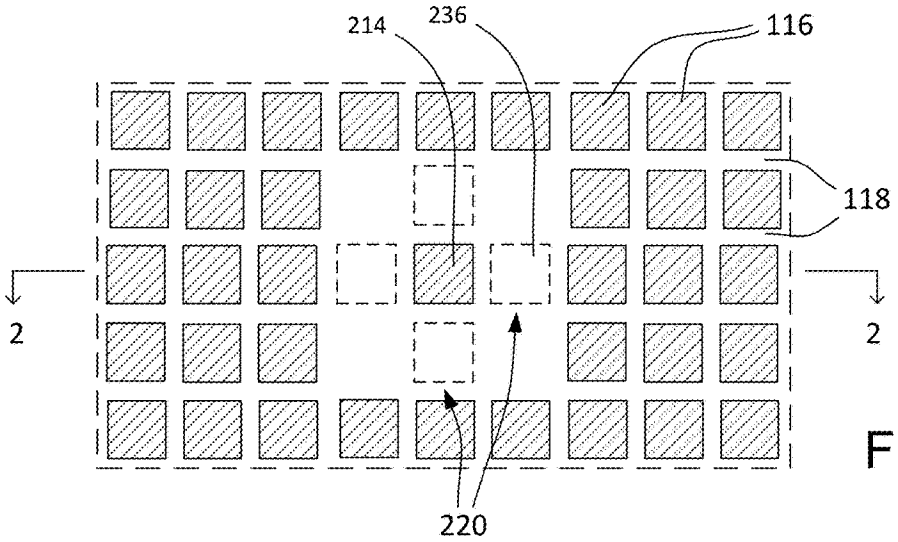
FIG. 3 is a schematic top view of the friction sensor and polishing pad of FIG. 2.

As shown in FIG. 3, in some implementations, the sensor 202 includes two pairs of capacitive pressure sensors 220 (i.e., four capacitive pressure sensors). The two sensors of each pair are positioned on opposing sides of a midline of the upper portion 214. In addition, the two pairs can be arranged to measure shear along perpendicular axes. With this configuration, the in-situ monitoring system 200 can generate a measurement indicative of a total frictional force, e.g., as a square root of the sum of the squares of the shear measured in the two perpendicular directions. This calculation can be performed by the controller 190. In some implementations, the sensor 202 includes three or more pairs of capacitive pressure sensors 220, with each pair of capacitive pressure sensors 220 including two capacitive pressure sensors on opposite sides of the pad portion 210. For example, although FIG. 3 illustrates empty spots diagonally above and below the pad portion 210, these spots could be occupied by additional capacitive pressure sensors.

Different substrate layers have different coefficients of friction between the deposited layers and the substrate contacting portion 214. This difference in coefficients of friction means that different deposited layers will generate different amounts of frictional force, and thus different amounts of shear on the sensor 202. If the coefficient of friction increases, the shear will increase. Similarly, if the coefficient of friction decreases, the shear will decrease. When deposited layer 16 has been polished down to expose the patterned layer 14, the shear will change to reflect the different coefficient of friction between the material of the deposited layer 14 and the polishing pad 110. Consequently, a computing device, such as the controller 190, can be used to determine the polishing endpoint by monitoring the changes in shear, and thus friction, detected by the in-situ monitoring system.

Figure 4:
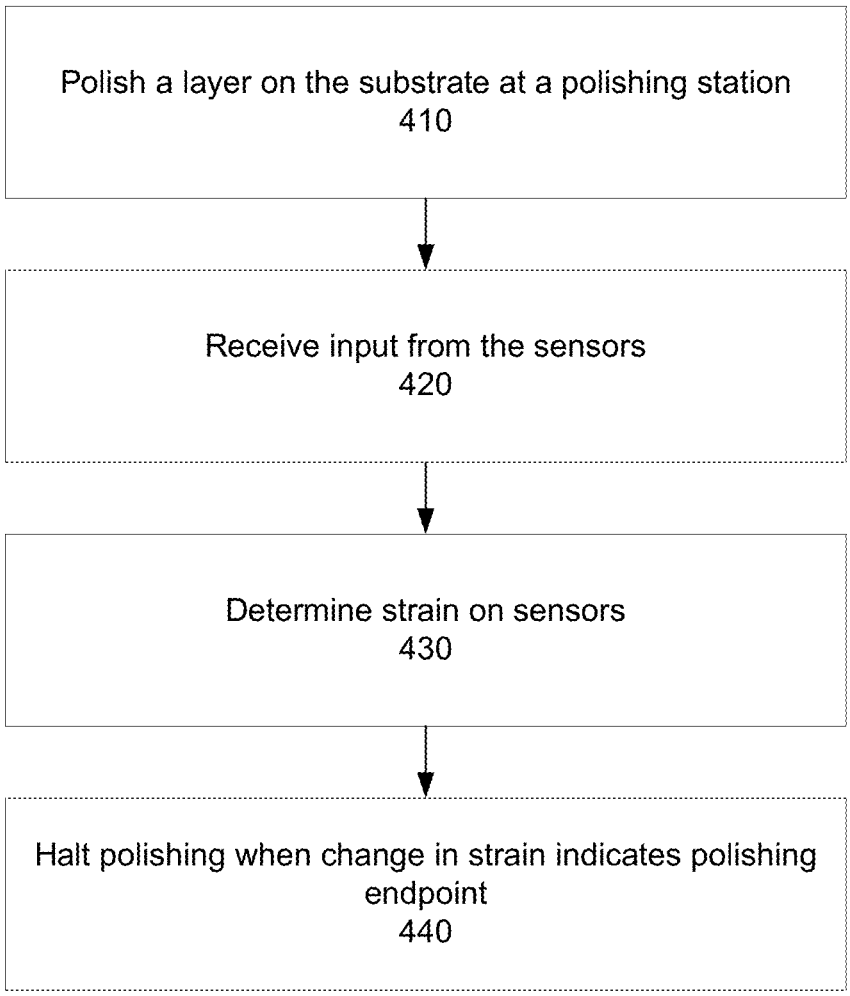
FIG. 4 is a flow chart illustrating a method of monitoring during polishing.

Referring to FIG. 4, the controller can be used to control the polishing system 100. An implementation of a computer program for chemical mechanical polishing begins with the initiation of a chemical mechanical polishing process on the substrate 10 (410). During the polishing process, the computer 90 receives input from the sensors 202 (420). Input from the individual capacitive sensors 220 can be received simultaneously or serially, an can be received continuously or periodically. The controller 190 (or the circuitry 250) receives the signals from the capacitive sensors 220 and determines the shear experienced by the sensor 202 (430). The controller 190 monitors the signal for changes in shear. When a change in shear indicates a desired polishing endpoint, the controller 190 ends the polishing process (440).

In some implementation, the controller 190 detects changes in the slope of the shear data to determine a polishing endpoint. The controller 190 can also monitor for shear signal smoothing to determine a polishing endpoint. Alternatively, the controller 190 consults a database containing pre-determined endpoint shear values based on the deposited layers used in order to determine the occurrence of an endpoint.

As noted above, the controller 190 can sort the measurements from the sensor 202 into radial ranges. The polishing parameters can then be adjusted based on the measurements, e.g., to provide improved uniformity. When the measurements indicate that an underlying layer has become exposed in a particular range, the polishing parameters can be adjusted to reduce the polishing rate in that range. Machine parameters that are independently controllable for the different radial ranges of the substrate, can then be controlled based on the measurements for the respective radial ranges.

In particular, the measurements may then be used for real-time closed loop control of the pressure applied by the carrier head 140. For example, if the controller 190 detects that the friction is changing in one radial zone, e.g., at the edge of the substrate, this can indicate that the underlying layer is being exposed, e.g., the underlying layer is being exposed first at the edge of the substrate. In response, the controller 190 can cause the carrier head 140 to reduce the pressure applied at the edges of the substrate. In contrast, if the controller 190 has not detected a change in friction in another radial range, e.g., a center portion of the substrate, this can indicate that the underlying layer is not yet exposed. The controller 190 can cause the carrier head 140 to maintain the pressure applied at the center of the substrate.

Referring to FIG. 1B, the in-situ monitoring system can include multiple sensors 202. For example, the in-situ monitoring system can include multiple sensors 202 placed at substantially the same distance from but at equal angular intervals around the axis of rotation of the platen. As another example, there can be sensors 202 positioned at different radial positions on the polishing pad 110. For example, the sensors 202 can be arranged in 3×3 grid. Increasing the number of sensors permits an increase in the sampling rate from the substrate 10.

To fabricate the sensor 202, the lower body 240 can be fabricated, e.g., as a printed circuit board having the electrodes 242. The polymer body 230 can be fabricated by injection molding. The electrodes 238 can be deposited in the recesses between the projections 232, e.g., by a sputtering process. The polymer body 230 is aligned and secured to the lower body 240 to form the capacitive sensors 220.

The assembly of the polymer body 230 and lower body 240 can then be placed into an aperture in the backing layer 114. Then the polishing layer 112 can be fabricated on top of the assembly and the backing layer. For example, the polishing layer 112 can be fabricated by a 3D printing process, e.g., by ejection and curing of droplets of pad precursor material. This permits the pad portion 210 and the remainder of the polishing layer 112 to be fabricated together as one continuous piece, i.e., without an adhesive, seam or similar discontinuity.

Alternatively, the polishing layer 112 could be fabricated separately, and then placed on the assembly and the backing layer 114, and secured, e.g., by adhesive.

Alternatively, the pad portion 210 can be secured to the assembly of the polymer body 230 and lower body 240 separately. Thereafter, the sensor 202 can be installed in the polishing pad 110, e.g., by being inserted into an aperture in the polishing pad 110 and secured, e.g., by adhesive.

The monitoring system can be used in a variety of polishing systems. Either the polishing pad, or the carrier head, or both can move to provide relative motion between the polishing surface and the substrate. The polishing pad can be a standard (e.g., polyurethane with or without fillers) rough pad, a soft pad, or a fixed-abrasive pad.

The functional operations described in this specification, e.g., for the controller and/or sense circuitry, can be implemented in digital electronic circuitry, or in computer software, firmware, or hardware, including the structural means disclosed in this specification and structural equivalents thereof, or in combinations of them. Embodiments can be implemented as one or more computer program products, i.e., one or more computer programs tangibly embodied in an information carrier, e.g., in a non-transitory machine readable storage medium or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a standalone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Figure 2:
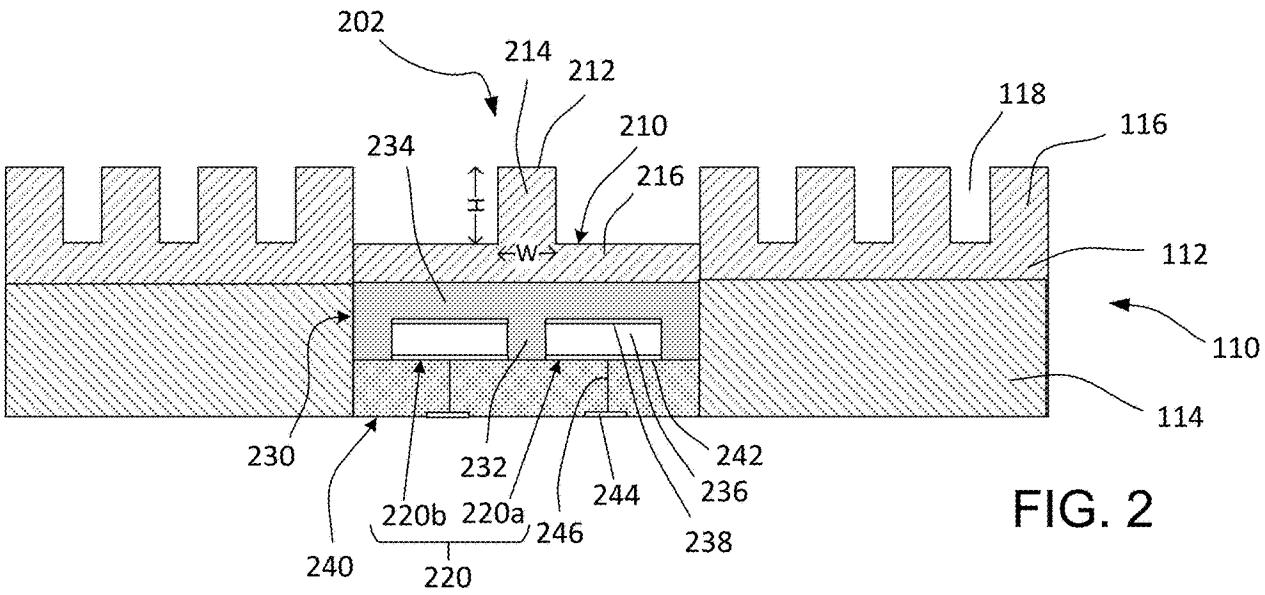
FIG. 2 is a schematic cross-sectional side view of a friction sensor in a portion of a polishing pad.

A number of embodiments have been described. Nevertheless, it will be understood that various modifications may be made without departing from the spirit and scope of this disclosure. For example:

- The top surface of the polymer body need not be coplanar with the top surface of the backing layer.
- Although FIG. 2 illustrates the polishing pad as having two layers, the polishing pad could be a single layer pad. A recess could be formed in the back surface of the polishing pad and the sensor inserted into the recess.
- The polishing pad could be built up around the sensor by a 3D printing process. For example, the assembly of the polymer body and lower body could be placed on a print stage, and the lower portion of the polishing pad could be fabricated around the assembly, e.g., by selectively ejecting droplets of precursor material into areas around but not on the assembly. This can build layers until the top of the pad material is coplanar with the top of the assembly. After this point, droplets of precursor material could be ejected across both the previously formed layers and the assembly, thus forming the pad portion and the upper portion of the remainder of the polishing pad.
- The technique of fabrication of the polishing pad by 3D printing around the assembly can be used for a single-layer pad, in which case the same material can be used throughout the pad, or for a multi-layer pad, in which case a different precursor or different curing technique can be used to form the lower portion (and thus the backing layer) of the polishing pad around the assembly.

Accordingly, other embodiments are within the scope of the following claims.

What is claimed is:

1. A polishing pad, comprising:

a polishing layer having a polishing surface;

a backing layer supporting the polishing layer;

a sensor assembly including i) a pair of vertically-separated laterally-extending parallel electrodes having a compressible gap therebetween to provide a capacitive pressure sensor positioned in an aperture in the backing layer and secured to the polishing pad, and ii) a pad portion supported on the capacitive pressure sensor and having a top surface coplanar with the polishing surface, wherein the pad portion comprises an upwardly-extending projection that is laterally offset relative to the pair of parallel electrodes.

2. The polishing pad of claim 1, wherein the pad portion comprises a lower portion, wherein the projection extends upwardly from the lower portion forming the top surface which forms a substrate contacting portion, and wherein the lower portion extends laterally beyond all sides of the substrate contacting portion.

3. The polishing pad of claim 2, wherein the lower portion is secured to the polishing layer.

4. The polishing pad of claim 3, wherein the lower portion is integrally joined to a remainder of the polishing layer.

5. The polishing pad of claim 1, wherein the polishing layer comprises a plurality of plateaus separated by grooves in the polishing surface, and wherein the projection is laterally spaced from nearest plateaus by a gap that is wider than the grooves.

6. The polishing pad of claim 1, wherein the sensor assembly includes a polymer body positioned between an upper electrode of the pair of electrodes and the pad portion.

7. The polishing pad of claim 6, wherein the sensor assembly includes a lower body having a lower electrode of the pair of electrodes formed thereon, and the upper electrode of the pair of electrodes is formed on the polymer body.

8. The polishing pad of claim 7, wherein the polymer body comprises a main body and a plurality of projections extending from the main body to contact the lower body, a recess between the projections defining the gap between the pair of vertically-separated laterally-extending parallel electrodes.

9. The polishing pad of claim 7, wherein the lower body comprises a printed circuit board.

10. The polishing pad of claim 7, wherein a bottom surface of the lower body is coplanar with a bottom surface of the polishing pad.

11. The polishing pad of claim 6, wherein the polymer body comprises molded silicone.

12. The polishing pad of claim 1, wherein the pad portion and the polishing layer have the same composition.

* * * * *